United States Patent [19]

Kopczynski

[11] Patent Number: 4,601,088

[45] Date of Patent: Jul. 22, 1986

[54] METHOD OF ASSEMBLING A PLATE-FIN HEAT EXCHANGER

[76] Inventor: John F. Kopczynski, 1671 Sweeney St., North Tonawanda, N.Y. 14120

[21] Appl. No.: 614,299

[22] Filed: May 25, 1984

[51] Int. Cl.[4] ..... B21D 53/02; B23P 15/26; B23P 19/04; B65H 1/02

[52] U.S. Cl. ..... 29/157.3 R; 29/157.4; 29/241; 29/433; 29/467; 29/726; 271/149; 271/161; 414/27; 414/28; 414/786

[58] Field of Search ..... 29/157.3 R, 157.3 C, 29/157.4, 726, 727, 467, 241, 433, 464; 414/27, 28, 786; 271/149, 150, 161

[56] References Cited

U.S. PATENT DOCUMENTS

| | | | |
|---|---|---|---|
| 3,228,367 | 1/1966 | Donaldson | 29/157.3 R |
| 3,440,704 | 4/1969 | Collins | 29/727 X |
| 3,468,009 | 9/1969 | Clausing | 29/727 X |
| 3,482,299 | 12/1969 | Davidson et al. | 29/727 X |
| 4,183,517 | 1/1980 | Hageman et al. | 271/150 |
| 4,195,540 | 4/1980 | Franks | 414/27 X |

*Primary Examiner*—Howard N. Goldberg
*Assistant Examiner*—Ronald S. Wallace
*Attorney, Agent, or Firm*—Joseph P. Gastel

[57] ABSTRACT

A method of assembling a plate-fin heat exchanger including the steps of providing a plurality of like substantially straight elongated plate-fins with spaced holes, bowing the plate-fins to increase their stability and accumulating a plurality of bowed plate-fins in stacked contiguous relationship to provide a bundle, providing a plurality of elongated substantially parallel tubes spaced from each other substantially the same distance as the spaced holes and oriented substantially perpendicularly to the bundle of plate-fins, transferring the bundle of bowed plate-fins to a carriage, straightening the bundle of contiguous plate-fins from the bowed condition to a straightened condition, and transferring the bundle of plate-fins in the stacked contiguous straightened condition onto the plurality of elongated substantially parallel tubes.

10 Claims, 18 Drawing Figures

METHOD OF ASSEMBLING A PLATE-FIN HEAT EXCHANGER

BACKGROUND OF THE INVENTION

The present invention relates to an improved method of assembling plate-fins onto tubes of a plate-fin heat exchanger.

By way of background, in the past plate-fins were transferred onto pins and accumulated into stacks of the desired size. Thereafter, these bundles of plate-fins were manually removed from the pins and manually mounted onto tubes of the heat exchanger. The foregoing procedure was relatively expensive because it required manual labor.

SUMMARY OF THE INVENTION

It is accordingly the object of the present invention to provide an extremely efficient, reliable and economical method of stacking plate-fins into bundles in an extremely stable manner, and then transfer the bundles onto tubes, all without the use of manual labor. Other objects and attendant advantages of the present invention will readily be perceived hereafter.

The present invention relates to a method of assembling a plate-fin heat exchanger comprising the steps of providing a plurality of like substantially straight elongated plate fins with spaced holes therein, bowing said plate-fins to increase their stability and accumulating a plurality of said plate fins in a stacked contiguous relationship to provide a bundle, providing a plurality of elongated substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes.

The various aspects of the present invention will be more fully understood when the following portions of the specification are read in conjunction with the accompanying drawings wherein:

DESCRIPTION OF THE PREFERRED EMBODIMENTS

Figures 1, 1A, 2, 3, 4, 5, 6, 7, 8:
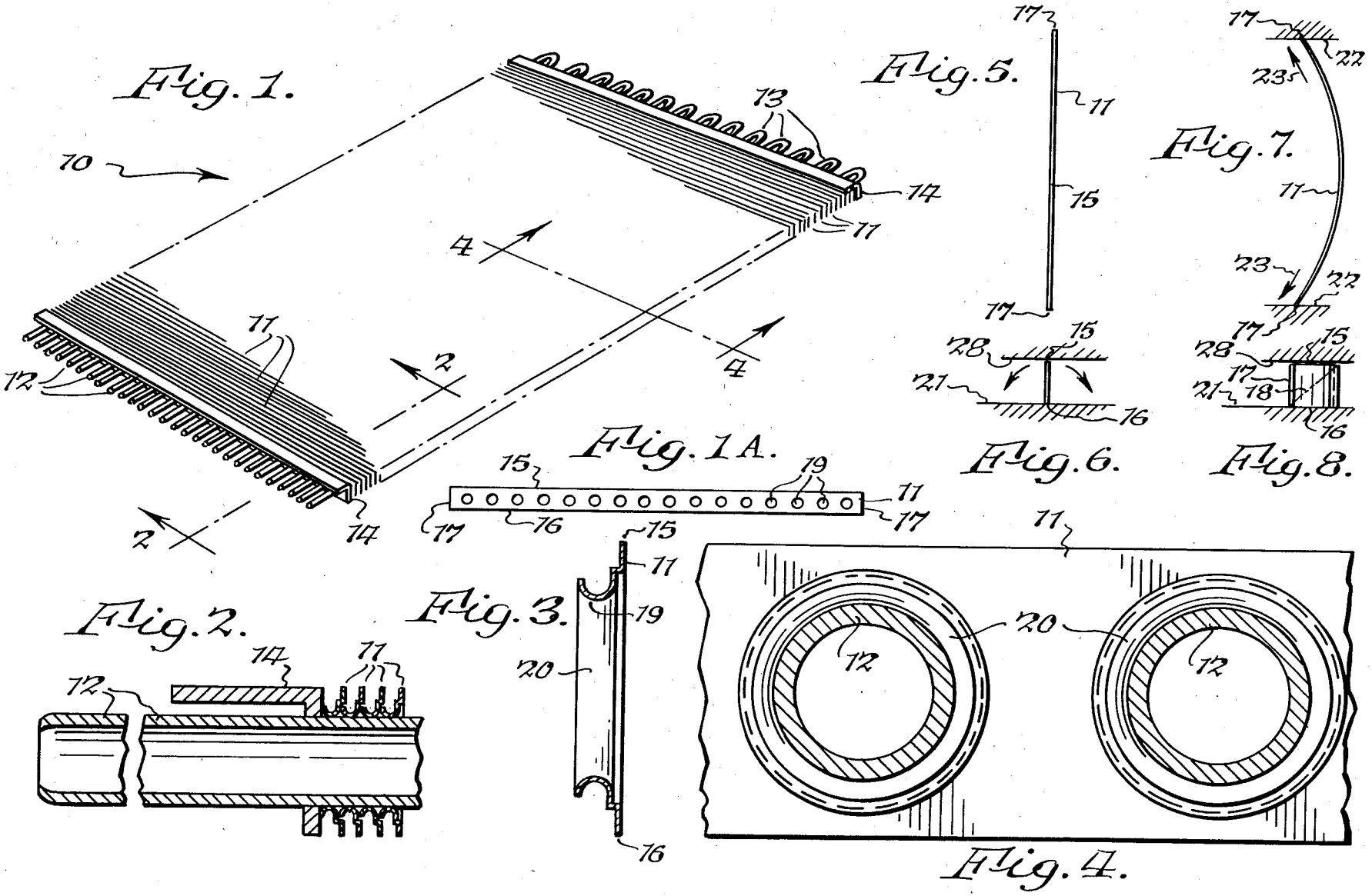
FIG. 1 is a perspective view of a plate-fin heat exchanger which is fabricated in accordance with the method of the present invention.
FIG. 1A is a side elevational view of a plate-fin.
FIG. 2 is a fragmentary enlarged cross sectional view taken substantially along line 2—2 of FIG. 1 and showing stacked plate-fins mounted on a tube.
FIG. 3 is an enlarged cross sectional view showing the shape of the combined tube-receiving openings and spacers of a plate-fin.
FIG. 4 is a fragmentary cross sectional view showing the relationship between a plate-fin and the tubes on which it is mounted.
FIG. 5 is a schematic plan view of a plate-fin in straightened condition.
FIG. 6 is a schematic end elevational view of the straight plate-fin of FIG. 5.
FIG. 7 is a schematic plan view of the plate-fin of FIG. 5 in a bowed condition.
FIG. 8 is a schematic end elevational view of the bowed plate-fin of FIG. 7.
Figures 12, 13, 14, 15, 16, 17:
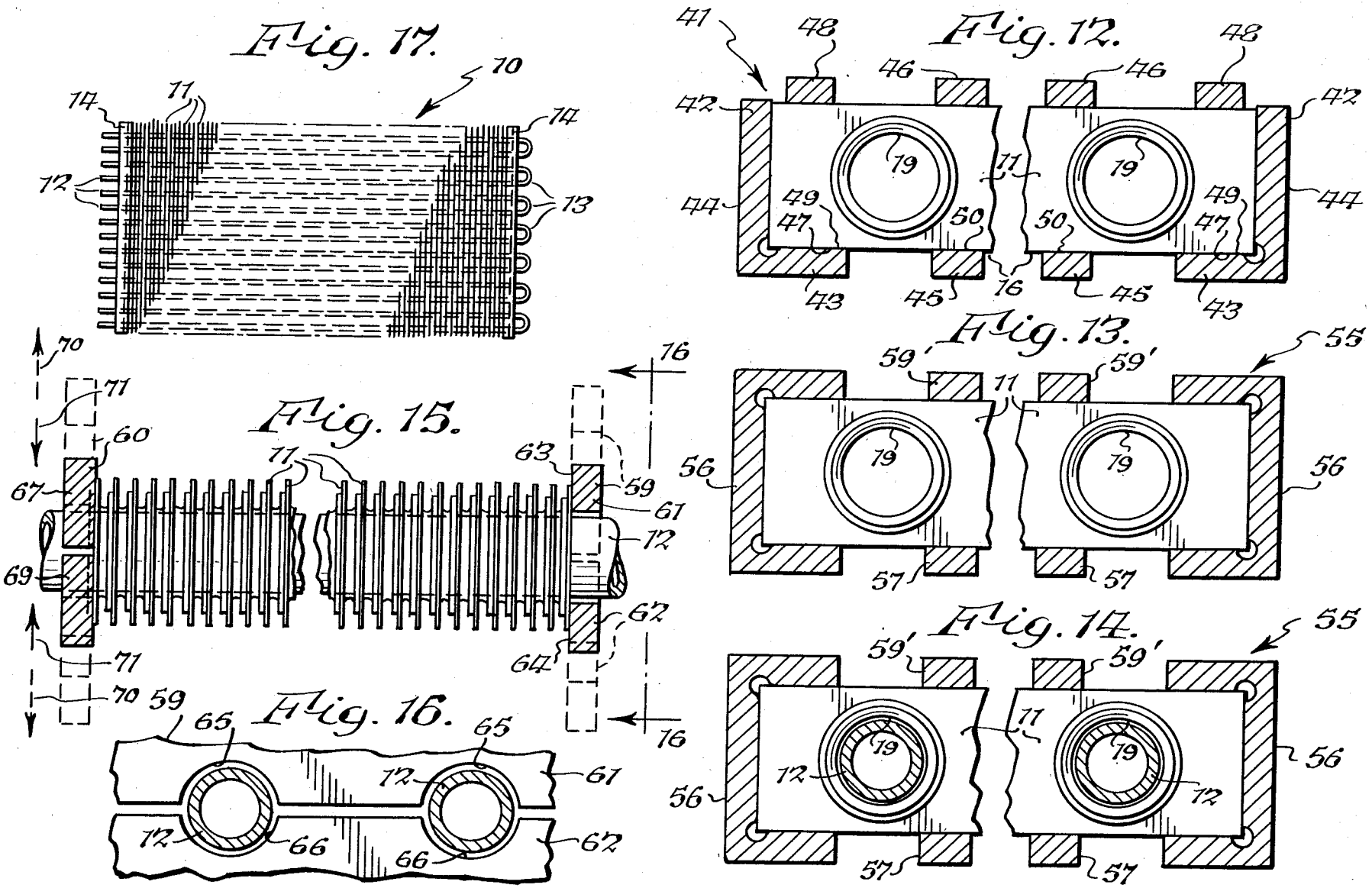
FIG. 12 is a fragmentary cross sectional view taken substantially along line 12—12 of FIG. 9 and showing the relationship between the bowed plate-fins and the accumulator in which they are stacked in continguous bowed relationship.
FIG. 13 is a fragmentary cross sectional view taken substantially along line 13—13 of FIG. 9 and showing how the stacked plate-fins are mounted in the carrier.
FIG. 14 is a fragmentary cross sectional view taken substantially along line 14—14 of FIG. 11 and showing the straightened stacked plate-fins being mounted on the tubes.
FIG. 15 is fragmentary view partially in cross section taken substantially along line 15—15 of FIG. 11 and showing a split fence utilized in conjunction with the carrier.
FIG. 16 is a fragmentary view taken substantially in the direction of arrows 16—16 of FIG. 15.
FIG. 17 is a plan view of the assembled heat exchanger.

The present invention relates to a method of fabricating the plate-fin heat exchanger 10 of FIGS. 1 and 17 which consists of a bundle of plate-fins 11 mounted in stacked contiguous relationship on a plurality of tubes 12 having hairpin turns 13 at their ends. Tube sheets 14 which are in the shape of angles are mounted at the ends of the bundle of stacked plate-fins. The plate-fin heat exchanger 10 is conventional in the art.

Each plate-fin 11 (FIGS. 1A, 2 and 3) is an elongated strip of metal having upper and lower edges 15 and 16, respectively, and outer edges 17. A plurality of holes 19 for receiving tubes 12 are spaced longitudinally of plate-fin 11. Each hole 19 is bounded by an annular rim 20 which is of the shape shown in FIG. 3 and is integral with the plate-fin. Rim 20 is formed by a combination of drawing and bending and it serves the dual function of attaching each plate-fin to the tube 12 and also spacing each plate-fin from an adjacent plate-fin. The plate-fins 11 are conventional.

As noted briefly above, in the past one method of assembling plate-fins 11 onto tubes 12 consisted of stacking them on pins until a predetermined number were accumulated and thereafter manually transferring them from the pins onto the tubes 12. The present invention eliminates the foregoing handling by accumulating a plurality of plate-fins in contiguous relationship without manual labor and thereafter transferring a bundle of stacked contiguous plate-fins directly onto tubes.

The underlying theory of maintaining the plate-fins 11 stacked in contiguous relationship ready to be mounted on tubes without manual labor is depicted in FIGS. 5–8. From FIGS. 5 and 6 it can be seen that if an elongated straight plate-fin is stood on its lower edge 16 on surface 21, it will tend to topple in the direction of either arrow. However, as can be seen from FIGS. 7 and 8, if plate-fin 11 is forced to a bowed condition by surfaces 22 bearing on opposite edges 17, it can be stood on its end 16 on surface 21 without toppling. Furthermore, even if a guide surface 28 is located adjacent top edge 15 of a straight plate-fin (FIG. 6), it can topple in both directions. However, if guide surface 28 is located adjacent top edge 15 of a bowed plate-fin (FIG. 8), it cannot topple in either direction. Stated another way, if the sum of the height of edge 17 plus the clearance between top edge 15 and surface 28 is less than the length of diagonal 18 (FIG. 8), the bowed plate-fin cannot under any circumstances topple clockwise or counterclockwise. In this respect, if it tended to topple clockwise, the upper left hand corners of the strip 11 would be stopped by the undersurfaces of guides 48 (FIG. 12). If it tended to topple counterclockwise in FIG. 8, which is highly unlikely, the top edge 15 would be stopped by the undersurfaces of guides 46 (FIG. 12). Furthermore, forcing plate-fin 11 to the bowed condition of FIG. 7 will cause forces in the direction of arrows 23 to be exerted on sides 22 because of the inherent resiliency of plate-fin 11. These forces will also aid in maintaining the fins in the desired position. It is the characteristics described relative to FIGS. 7 and 8 which form the basis of the improved method of the present invention.

Figure 9:
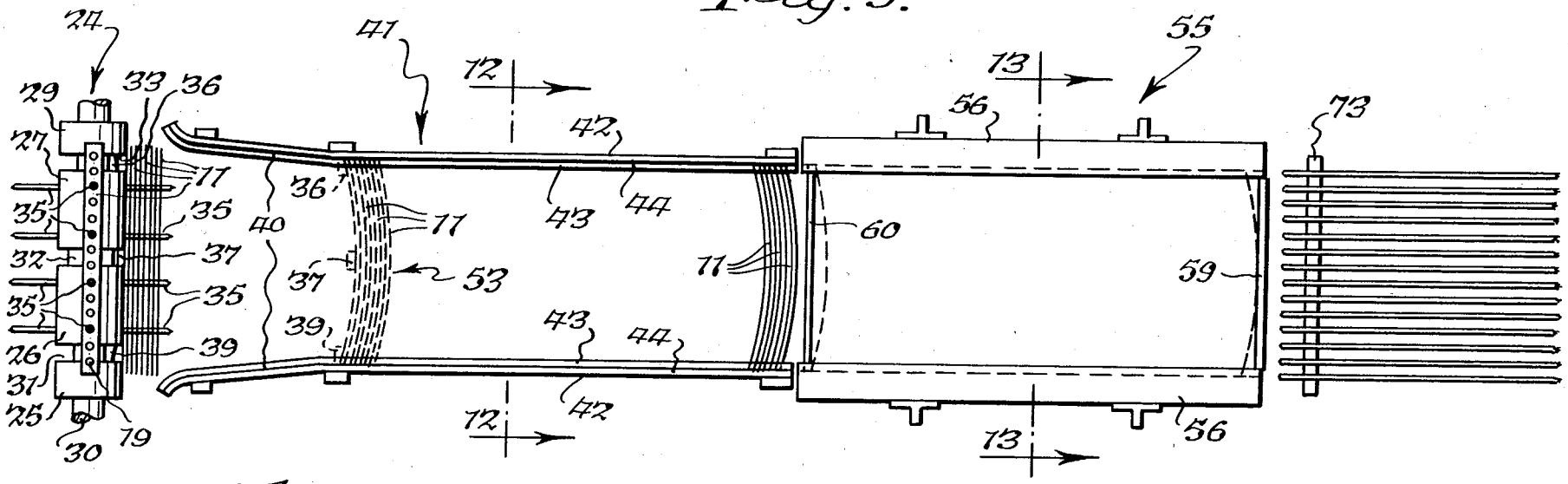
FIG. 9 is a schematic plan view depicting the method of the present invention wherein individual plate-fins are bowed to retain them in stacked contiguous relationship and are thereafter transferred to a carriage for mounting on tubes.

The improved method of the present invention is shown in FIGS. 9–16. In FIG. 9 a device 24 is shown for receiving a plurality of plate-fins 11 from a punch press. The device 24 may be a plurality of cylinders 25, 26, 27 and 29 mounted on shaft 30 with spaces 31, 32 and 33 between cylinders as shown. Extending upwardly from cylinders 26 and 27 are a plurality of spikes 35 which extend through holes 19 of plate-fins 11. After a predetermined number of plate-fins 11 are mounted on pins 35, shaft 30 will be caused to rotate so that the stack of plate-fins 11 on pins 35 assume the position shown in FIG. 9.

A plurality of rake fingers 36, 37 and 39, which are located in spaces 33, 32 and 31, respectively, are caused to move to the right and thus move the stack of plate-fins 11 off of pins 35 and into funnel 40 of accumulator 41 (FIGS. 9 and 12) which consists of spaced angle-shaped rails 42 having horizontal legs 43 and vertical legs 44. Central rake fingers 37 may be located forward of rake fingers 34 and 36 to aid the bowing of the plate-fins. Also, elongated rails 45 are positioned in line with legs 43 to support the lower edges 16 of plate-fins 11. Elongated guide members 46 and 48 are also positioned on accumulator 41 to guide the upper edges 15 of the plate-fins 11. Suitable clearances are provided between upper edges 15 of plate-fins 11 and the lowermost edges of guide members 46 and 48. Guide surfaces 49 and 50 of FIG. 12 are analogous to surface 21 of FIGS. 6 and 8, and guides 46 and 48 of FIG. 12 provide guide surfaces which are analogous to surface 28 of FIGS. 6 and 8. Members 45, 46 and 48 may extend the entire length of rails 42 but have been omitted from FIG. 9 in the interest of clarity.

As the stack of plate-fins 11 is moved off of pins 35 by rake fingers 36, 37 and 39, the lower outer edge portions 47 will come to rest on the upper surfaces 49 of horizontal legs 43 and the lower surfaces 16 will be supported on upper surfaces 50 of elongated members 45. As the stack of plate-fins 11 is moved through the converging sides 51 of the funnel portion 40 of the accumulator, the outer edges 17 of plate-fins 11 will eventually contact the inner edges 22 of vertical legs 44 in the funnel portion 40 so that the stack of plate-fins 11 will start assuming a bowed condition until they reach the fully bowed condition at position 53. Because the plate-fins 11 are bowed, they will be self-sustaining, that is, they will be able to stand on their lower edges 16 without toppling. Furthermore, they will be supported in an upright vertical position because of the frictional engagement between outer edges 17 and inner surfaces 22 of rails 42. In addition, the frictional engagement between the outer edges 17 and surfaces 22 will hold adjacent plate-fins 11 in contiguous abutting relationship. It will be understood that the moving of the stack of plate-fins 11 to the bowed condition is a gradual process as they move from a position where they do not contact surfaces 22 to a position within funnel 40 wherein they initially make contact with the portions of surfaces 42 and then they are gradually bowed to the condition shown at 53 by the converging sides 51 of funnel 40.

After one stack of plate-fins 11 has been moved to position 53, another stack is moved to this position and the second stack will move the first stack to the right by the amount of space which it occupies. The foregoing movement of stacks of plate-fins 11 into accumulator 41 will progress in increments until the desired number of stacks are accumulated in the bundle which consists of a plurality of stacks. As noted above, because each plate-fin 11 is supported across surfaces 49 and 50 (FIG. 12) in the accumulator in a bowed condition, it will not tip from side to side in the direction of the arrows of FIG. 6. Furthermore, the frictional engagement between outer edges 17 of the plate-fins and surfaces 22 will maintain the plate-fins in contiguous adjacent relationship wherein the spacer rims 19 maintain a nested relationship with each other as can be visualized from FIG. 2. In other words, the accumulator 41 maintains the plate-fins 11 in stacked contiguous relationship with all of the holes 19 aligned with each other.

After a bundle of plate-fins 11 are accumulated in accumulator 41, a suitable transfer mechanism (not shown) transfers this bundle of plate-fins in bowed condition to a carriage 55 having side rails 56 which are movable toward and away from each other. Initially, side rails 56 are spaced apart the same amount as surfaces 22 of FIG. 12. Side rails 56 (FIGS. 9 and 13) are in the shape of channel members. Furthermore, lower guide members 57 and upper guide members 59' (FIG. 13) extend the length of carriage 15 for providing support to the central portions of plate-fins 11.

Carriage 55 moves the bundle of plate-fins 11 onto tubes 12 in the following manner. First of all, suitable mechanism is provided for moving side rails 56 outwardly relative to each other in the direction of arrows 57' from their initial position where they are spaced the same amount as rails 42 (FIG. 12). Coordinated with this movement, front and rear fences 59 and 60, respectively, are moved toward each other by suitable mechanism to straighten the plate-fins 11 from the bowed condition of FIG. 9 to the straightened condition of FIG. 10. Fences 59 and 60 may be identical and may comprise an upper plate 61 and a lower plate 62 (FIGS. 15 and 16). Surfaces 63 and 64 of plates 61 and 62, respectively, engage the planar surface of the plate-fin adjacent thereto. The cutouts 65 and 66 of plates 61 and 62, respectively, accommodate tubes 12 when they are inserted into the holes 19 defined by spacer rims 20. Plates 61 and 62 of fence 59 and the corresponding plates 67 and 69 of fence 60, which may be identical to plates 61 and 62, are movable away from each other in the direction of arrows 70 and they are movable toward each other in the direction of arrows 71 to permit the fences to be moved out of the way as required. In this respect, the leading fence 61 is moved out of the way to the dotted line position when it is no longer necessary to support the plate-fin adjacent thereto. Plates 67 and 69 of rear fence 60 are moved out of the way when a bundle is transferred onto carriage 55 from accumulator 41.

It will be appreciated that where the bowing of plate-fins 11 in the bundle carried by carriage 55 is sufficiently slight and where the holes 19 are sufficiently large, the bundle may be mounted on tubes 12 without the above-described step of straightening the plate-fins by fences 59 and 60. The straightening can be effected after the bundle is properly mounted on tubes 12.

Figure 11:
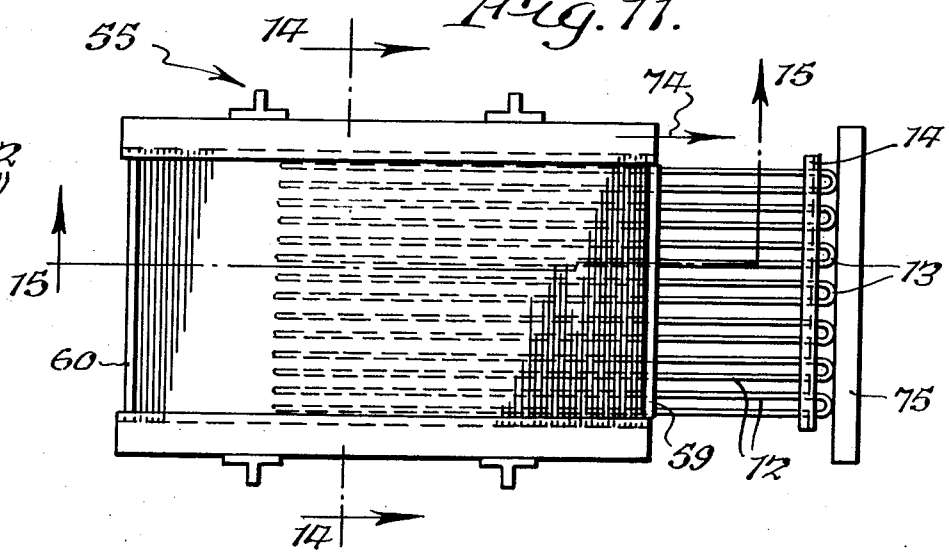
FIG. 11 is a view similar to FIG. 10 but showing the plate-fins being mounted on the tubes.
Figure 10:
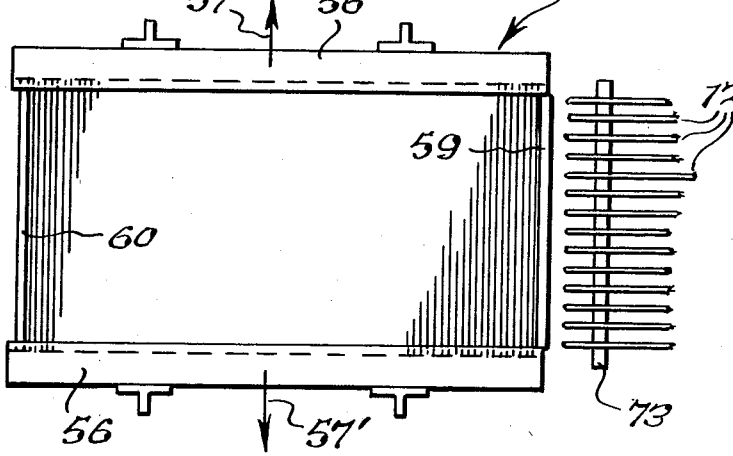
FIG. 10 is a schematic view of the carriage of FIG. 9 after its sides have been moved apart and the stacked plate-fins have been straightened from their bowed condition preparatory to mounting on the tubes.

A support 73 for the ends of tubes 12 is schematically shown in FIGS. 9 and 10. This support may have cutouts, such as 66, shown in FIG. 16. Once the ends of tubes 12 have been received in the bundle of plate-fins on carriage 55, support 73 is retracted so as not to interfere with movement of the carriage in the direction of arrow 74 onto tubes 12. An abutment 75 is schematically shown in FIG. 11 and it represents the holding of tubes 12 against movement in the direction of arrow 74 as carriage 55 moves in this direction.

If desired, movable gripper members may be provided which extend parallel to guides 57 and 59' of the carriage 55. These grippers hold the tops and bottoms of the plate-fins during the movement of the carriage to mount the bundle of plate-fins onto tubes 12.

While in the foregoing description a carriage 55 has been used to transfer a bundle of plate-fins from the accumulator 41 onto tubes 12, it will be appreciated that with suitable modifications, carriage 55 can be eliminated. In this respect, the tube bundle would be transferred directly from accumulator 41 onto tubes 12. This transferring can be effected by moving the tubes 12 into the bowed plate-fins or by moving a separable portion of accumulator 41 toward tubes 12. The tubes can be inserted into the bowed plate-fins when clearances permit.

As an alternate construction wherein the carriage 55 has been eliminated, straightening fences, such as 59 and 60, can be associated with the accumulator 41 so that straightening can occur therein in the same manner as described above relative to carriage 55. In this respect, mechanism would have to be provided for moving side rails 42 outwardly in the same manner as side rails 56 of carriage 55 are moved outwardly, when the fences associated with the accumulator are moved toward each other to straighten the plate-fins.

In the embodiment of FIG. 9, while it has been disclosed that the carriage 55 moves toward stationary tubes 12, as shown in FIG. 11, it will be appreciated that the carriage can remain stationary and that the tubes 12 can be moved toward the carriage.

In the foregoing description references have been made to inserting the tubes into the plate-fins in a bowed condition wherein the outer edges 17 exert forces 3 (FIG. 7) on surfaces 22. This relationship produces a braking or locking action between each plate-fin and surfaces 22 tending to prevent the plate-fins from moving to the left in FIG. 7 when the tubes 12 are moved from right to left into a bundle of bowed tubes.

It thus can be seen that the improved method of the present invention is manifestly capable of achieving the above enumerated objects, and while preferred embodiments of the present invention have been disclosed, it will be appreciated that it is not limited thereto but may be otherwise embodied within the scope of the following claims.

What is claimed is:

1. A method of assembling a plate-fin heat exchanger comprising the steps of providing a plurality of like substantially straight elongate plate fins with spaced holes therein, bowing said plate-fins to increase their stability and accumulating a plurality of said plate fins in a stacked contiguous relationship to provide a bundle, providing a plurality of elongated substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes by inserting said substantially parallel tubes into said spaced holes, transferring said bundle of bowed plate-fins to a carriage, and transferring said bundle of plate-fins from said carriage onto said plurality of elongated substantially parallel tubes.

2. A method of assembling a plate-fin heat exchanger as set forth in claim 1 including the step of straightening said bundle of bowed plate-fins to a straightened condition prior to transferring them onto said tubes.

3. A method of assembling a plate-fin heat exchanger as set forth in claim 2 wherein said straightening step is performed on said carriage.

4. A method of assembling a plate-fin heat exchanger comprising the steps of providing a plurality of like substantially straight elongated plate fins with spaced holes therein, bowing said plate-fins to increase their stability and accumulating a plurality of said plate fins in a stacked contiguous relationship to provide a bundle, providing a plurality of elongate substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes by inserting said substantially parallel tubes into said spaced holes, said step of accumulating said plurality of plate fins in said bowed condition being effected by moving said plate fins into a space between rails which are spaced apart a distance which is less than the length of said elongated plate fins to thereby force said elongated plate fins to assume said bowed condition, said bowing being convex in the direction of travel of said elongated plate fins into said space between said rails, causing said elongate plate fins to be held in said stacked contiguous relationship by causing the outer ends of said bowed elongate plate fins to frictionally engage said rails, said bowing creating an outward force at the ends of said plate fins which creates said frictional engagement, said step of mounting said stacked contiguous plate fins including the step of transferring said stacked contiguous plate fins in said bowed condition to a carriage, straightening said stacked contiguous plate fins in said carriage, and and causing said carriage to move said straightened stacked plate fins onto said substantially parallel tubes.

5. A method as set forth in claim 4 wherein said carriage includes second rails which are spaced apart substantially the same distance as said rails when said stacked contiguous plate fins are transferred thereto, and wherein said straightening step is effected by moving said second rails apart and applying opposing forces to the central portions of said stacked contiguous plate fins.

6. A method of assembling a plate-fin heat exchanger comprising the steps of providing a plurality of like substantially straight elongated plate-fins with spaced holes therein, moving said elongated plate-fins into a space between rails which are spaced apart a distance which is less than the length of said elongated plate-fins to thereby produce a stack of said elongated plate-fins in a bowed condition having a convex bowed side and a concave bowed side and wherein said moving of said plate-fins into said space between said rails is effected by applying forces to said plate-fins on said concave bowed side, moving said rails apart, applying opposing forces to central portions of a plurality of stacked plate-fins on said convex bowed side and on said concave bowed side to straighten said plate-fins from said bowed condition, providing a plurality of elongated substantially parallel tubes spaced from each other substantially the same distance as said spaced holes and oriented substantially perpendicularly to said stacked plate-fins, and moving said plurality of said stacked plate-fins in a straightened condition and said plurality of substantially parallel tubes relative to each other to insert said stacked tubes into said spaced holes in said plate-fins.

7. A method of assembling a plate-fin heat exchanger comprising the steps of providing a plurality of like substantially straight elongated plate fins with spaced holes therein, bowing said plate-fins to increase their stability and accumulating a plurality of said plate fins in a stacked contiguous relationship to provide a bundle, providing a plurality of elongated substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes by inserting said substantially parallel tubes into said spaced holes, said step of accumulating said plurality of plate fins in said bowed condition being effected by moving said plate fins into a space between rails which are spaced apart a distance which is less than the length of said elongated plate fins to thereby force said elongated plate fins to assume said bowed condition, said bowing being convex in the direction of travel of said elongated plate fins into said space between said rails, causing said elongated plate fins to be held in said stacked contiguous relationship by causing the outer ends of said bowed elongated plate fins to frictionally engage said rails, said bowing creating an outward force at the ends of said plate fins which creates said frictional engagement, said plate-fins having upper and lower edges, and the step of guiding said upper and lower edges to maintain said upper and lower edges and said spaced holes in alignment while said plate-fins are being accumulated between said rails.

8. A method as set forth in claim 7 wherein said convex bowing causes said stack to have a convex bowed side and a concave bowed side, and wherein said moving of said plate-fins into a space between rails is effected by applying forces to said plate-fins on said concave bowed side.

9. A method of assembling a plate-fin heat exchanger comprising the steps of providing a plurality of like substantially straight elongated plate fins with spaced holes therein, bowing said plate-fins to increase their stability and accumulating a plurality of said plate fins in a stacked contiguous relationship to provide a bundle, providing a plurality of elongated substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes by inserting said substantially parallel tubes into said spaced holes, said step of accumulating said plurality of plate fins in said bowed condition being effected by moving said plate fins into a space between rails which are spaced apart a distance which is less than the length of said elongate plate fins to thereby force said elongated plate fins to assume said bowed condition, said bowing being convex in the direction of travel of said elongated plate fins into said space between said rails, causing said elongated plate fins to be held in said stacked contiguous relationship by causing the outer ends of said bowed elongated plate fins to frictionally engage said rails, said bowing creating an outward force at the ends of said plate fins which creates said frictional engagement, said convex bowing causing said stack to have a convex bowed side and a concave bowed side, said step of mounting said plurality of plate-fins in said stacked contiguous relationship onto said plurality of elongated substantially parallel tubes comprising moving said tubes and said stacked contiguous plate-fins relative to each other with said tubes entering said spaced holes of said stacked contiguous plate-fins from said convex bowed side thereof, said plate-fins having upper and lower edges, providing guide means in contiguous relationship to said upper and lower edges to prevent said bowed plate-fins from moving out of said stacked contiguous relationship while being held within said rails, said moving of said plate-fins into a space between rails being effected by applying forces to said plate-fins on said concave bowed side, and exerting forces onto said concave bowed side during said step of mounting said plurality of plate-fins onto said plurality of tubes.

10. A method of assembling a plate-fin heat exchanger comprising the steps of providing a plurality of like substantially straight elongated plate fins with spaced holes therein, bowing said plate-fins to increase their stability and accumulating a plurality of said plate fins in a stacked contiguous relationship to provide a bundle, providing a plurality of elongated substantially parallel tubes spaced from each other substantially the same distance as said spaced holes and oriented substantially perpendicularly to said stacked plate fins, and mounting said plurality of plate fins in said stacked contiguous relationship onto said plurality of elongated substantially parallel tubes by inserting said substantially parallel tubes into said spaced holes, said step of accumulating said plurality of plate fins in said bowed condition being effected by moving said plate fins into a space between rails which are spaced apart a distance which is less than the length of said elongated plate fins to thereby force said elongated plate fins to assume said bowed condition, said bowing being convex in the direction of travel of said elongated plate fins into said space between said rails, causing said elongated plate fins to be held in said stacked contiguous relationship by causing the outer ends of said bowed elongated plate fins to frictionally engage said rails, said bowing creating an outward force at the ends of said plate fins which creates said frictional engagement, said convex bowing causing said stack to have a convex bowed side and a concave bowed side, said step of mounting said plurality of plate-fins in said stacked contiguous relationship onto said plurality of elongated substantially parallel tubes comprising moving said tubes and said stacked contiguous plate-fins relative to each other with said tubes entering said spaced holes of said stacked contiguous plate-fins from said convex bowed side thereof, and exerting forces onto said concave bowed side during said step of mounting said plurality of plate-fins onto said plurality of tubes.

* * * * *

UNITED STATES PATENT AND TRADEMARK OFFICE

CERTIFICATE OF CORRECTION

PATENT NO. : 4,601,088

DATED : July 22, 1986

INVENTOR(S) : John F. Kopczynski

It is certified that error appears in the above-identified patent and that said Letters Patent are hereby corrected as shown below:

Column 2, line 26, after "FIG. 15;" insert --and--.

Column 4, lines 41 and 42, change "surfaces 22" to --rails 42--.

Column 5, line 58, change "forces 3" to --forces 23--.

Column 6, line 6 (claim 1), change "elongate" to --elongated--;

line 34 (claim 4), change "elongate" to --elongated--;

line 49 (claim 4), change "elongate" to --elongated--;

line 51 (claim 4), change "elongate" to --elongated--.

Column 8, line 10 (claim 9), change "elongate" to --elongated--.

Signed and Sealed this

Seventh Day of October, 1986

[SEAL]

*Attest:*

DONALD J. QUIGG

*Attesting Officer*

*Commissioner of Patents and Trademarks*